US005308275A

United States Patent [19]

Kornbleuth

[11] Patent Number: 5,308,275

[45] Date of Patent: May 3, 1994

[54] SLEEVE PUPPET

[75] Inventor: Eric J. Kornbleuth, Voorhees, N.J.

[73] Assignee: Neushama Enterprises, LP, Brooklyn, N.Y.

[21] Appl. No.: 22,451

[22] Filed: Feb. 25, 1993

[51] Int. Cl.[5] ..... A63H 33/80; A63H 3/14; A41B 1/00; A41D 1/04

[52] U.S. Cl. ..... 446/28; 446/329; 2/69; 2/90; 2/115; 2/158

[58] Field of Search ..... 446/28, 27, 26, 329, 446/328, 327; 2/69, 90, 115, 158

[56] References Cited

U.S. PATENT DOCUMENTS

| | | | |
|---|---|---|---|
| 796,711 | 8/1905 | Ferguson | 2/115 X |
| 1,092,047 | 3/1914 | Hertz | 2/158 X |
| 1,567,896 | 12/1925 | Anderton, Jr. | 2/115 |
| 1,647,656 | 11/1927 | Olsen | 2/115 |
| 2,836,828 | 6/1958 | Henrikson | 2/158 |
| 2,929,170 | 3/1960 | Brown et al. | 446/329 |
| 3,747,264 | 7/1973 | Brandwein | 446/329 |
| 4,756,027 | 7/1988 | Buenos et al. | 2/158 |
| 4,795,398 | 1/1989 | Wexler | 446/327 |
| 4,909,769 | 3/1990 | Paterson | 446/28 |
| 5,022,093 | 6/1991 | Hall | 2/158 |
| 5,117,507 | 6/1992 | Long | 446/329 X |

*Primary Examiner*—David N. Muir
*Attorney, Agent, or Firm*—Norman E. Lehrer

[57] ABSTRACT

A garment having an amusement device in the form of a puppet being integrally a part thereof and attached to the sleeves of the garment. The puppet is formed from the sleeve of a garment having two distinct layers of material which are attached at one end. A first layer extends into a second layer wherein the first layer is attached to the second layer at the end of the sleeve through which the hand extends. The interior end of the second inner layer is substantially unattached to the outer layer. Because of the substantially unattached interior end, an upper and a lower cavity is formed within the sleeve between the two layers of material. Accordingly, the fingers of the hand may be placed in the upper and lower cavities for manipulating the end of the sleeve and forming a puppet. When desired, the inside layer can be folded outwardly to form a cuff such that the puppet is hidden from view. Upon unfolding the cuff, the puppet is exposed. Ornamental items which represent facial features of a puppet, including hair, eyes and nose are applied to the outer layer of material. In the unfolded position, the cavities can be moved in an upward and downward manner such that the inner layer of material represents the mouth and the outer layer of material represents the face of the puppet. Upon conclusion of playing with the puppet, the inner layer may be folded outwardly over the ornamental items to form the cuff and thereby hide the puppet from view.

3 Claims, 2 Drawing Sheets

SLEEVE PUPPET

BACKGROUND OF THE INVENTION

This invention relates to amusement devices attached to clothing. More particularly, the invention is directed toward a garment having puppets as integral parts of the sleeves of the garment yet hidden from view when not being used.

Amusement devices having a direct relationship to articles of clothing have been developed primarily to appease children. As a general statement, children are not excited to receive clothing as a gift. Most children would prefer to receive a toy in lieu of clothing because it's simply more fun. As a result, clothing has been developed having amusement devices attached thereto or a part thereof in some manner. However, in most instances in the prior art, it is readily apparent from viewing the clothing that a toy is attached. From a practical and an aesthetic viewpoint, toys attached to children's clothing being permanently visible and non-concealable are not popular among parents. The prior art discloses several of these types.

Sesco, Jr. U.S. Pat. No. 3,308,479, for example, discloses a puppet-equipped protective cloth for use with children. The protective cloth includes those used at barber shops, i.e. hair cloths, and bibs used for protecting the child from getting food upon him or herself. As shown in FIGS. 2 and 4 of the Sesco patent, puppets are attached to the protective cloth so that a child can manipulate them while the cloth is being worn. Accordingly, there are holes in the cloth in alignment with the puppet so that a child can put his hands through the holes in the cloth and into the puppets to play with them. The puppets are sewn or otherwise attached to the protective cloth. However, as shown in the figures, the puppets cannot be hidden from view while they remain attached to the cloth if the child is wearing the cloth in the normal manner.

Brosk U.S. Pat. No. 3,447,165 discloses a garment having a puppet attached to the pocket of the garment. The puppet is attached to the outer portion of the pocket such that the wearer of the garment can place her hand into the pocket and manipulate the puppet. As is obvious from the drawings, the puppet is permanently attached to the outer portion of the garment and, therefore, cannot be removed from sight during normal wear of the same.

Greenspan Similarly, U.S. Pat. No. 4,318,745 discloses a puppet for a clothing pocket. The puppets in Greenspan are attached to the garment pockets. The garment wearer may place her hands into the pockets to manipulate them for her own amusement or for the entertainment of others. When the puppets are not being used, they are designed for being stored within the existing pockets of the garment. As shown in FIG. 1 of the patent, however, the puppets are not attached to the sleeves nor are they storable therein.

SUMMARY OF THE INVENTION

This invention is directed toward a puppet attached to and integral with a part of a garment. The puppet is attached to and formed by the sleeves of the garment yet may be hidden from view during non-use.

In accordance with the invention, the amusement toy comprises a garment sleeve formed from a first and a second layer of material attached together. The first layer comprises the outer portion of the sleeve, while the second layer comprises a preferably ornamentally-decorated inner portion of the sleeve. The materials are attached so that the second layer is positioned inside the first layer and concentric to the same. The layers are attached at the open end of the sleeve along a circular seam. Because only one end is sewn together, the interior end of the second layer, extending into the sleeve from the open end, is freely movable relative to the first layer. Accordingly, there are upper and lower accessible cavities between the two layers wherein the hand of the person wearing the garment can be placed. As such, when it is desired to use the puppet, the hand is placed in these upper and lower cavities and the puppet can be manipulated, the inner layer of material forming the mouth of the puppet. On the first or outer layer of the material, decorative items are sewn and configured to represent the facial features of the puppet.

When the puppet is not being used, the second or inner layer can be folded outwardly to form a cuff and expose the ornamentally decorated surface of the second layer. When the second or inner layer is folded outwardly, the decorative face items are hidden under the cuff so as to remove them and the body of the puppet from sight. In this configuration, the garment resembles a normal garment with cuffed sleeves.

The sleeve puppet can be used with a variety of different garments having sleeves including sweaters, sweatshirts, long-sleeve shirts and jackets. The capacity of this garment to hide the puppet in the sleeve adds to the art a feature beloved by all children, the element of surprise.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 3:
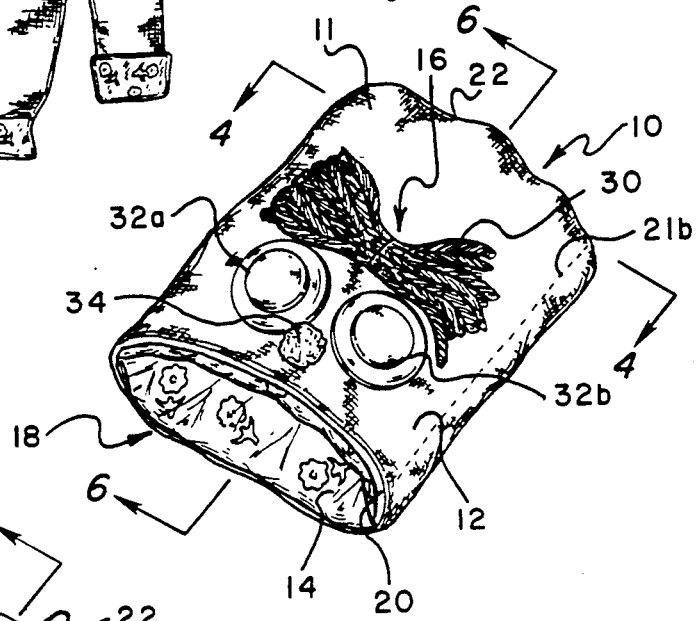
FIG. 3 is an enlarged perspective view similar to FIG. 2 but showing the puppet wherein the sleeve is in the uncuffed position.

Referring now to the drawings in detail wherein like reference numerals have been used throughout the various figures to designate like elements, there is shown in FIG. 3 a perspective view of the sleeve puppet constructed in accordance with the principals of the present invention and designated generally as 10. The puppet is comprised of sleeve 11 having an outer layer 12 of fabric material and an inner layer 14 of fabric and the ornamental items attached thereto, designated generally as 16.

Figure 6:
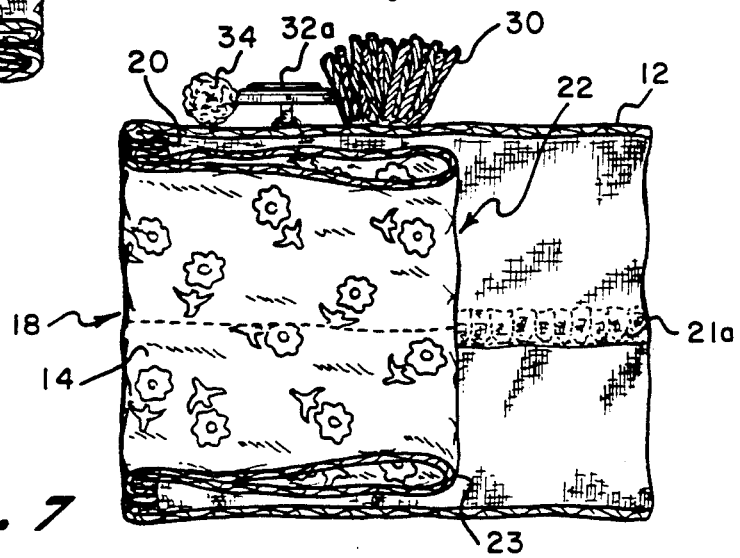
FIG. 6 is a cross-sectional view taken along line 6—6 of FIG. 3.

The sleeve puppet 10 is comprised of the outer layer of material 12 connected to the inner layer of material 14. The outer layer 12 is actually the outer sleeve material and is connected to the inner layer 14 at the open end 18 of the sleeve. The inner and outer layers are sewn together along the seam 20 at the end of the sleeve and along the side seams 21*a* and 21*b*. The inner layer 14 extends up the sleeve within the outer layer 12, as shown in FIG. 3 and FIG. 6, such that it is unconnected to the outer sleeve 12 at its interior end 22. The inner layer 14 is preferably ornamental or of a different color than the main body of the garment 24. The inner layer 14 is also preferably constructed from two layers of material so that the inner layer does not become frayed or otherwise damaged by the constant movement of a hand or arm against the free end 22. As shown most clearly in FIG. 6, the free end 22 is formed from the fold of the inner layer into two layers so as to avoid any loose edges in the area of hand insertion and arm movement.

Figure 1:
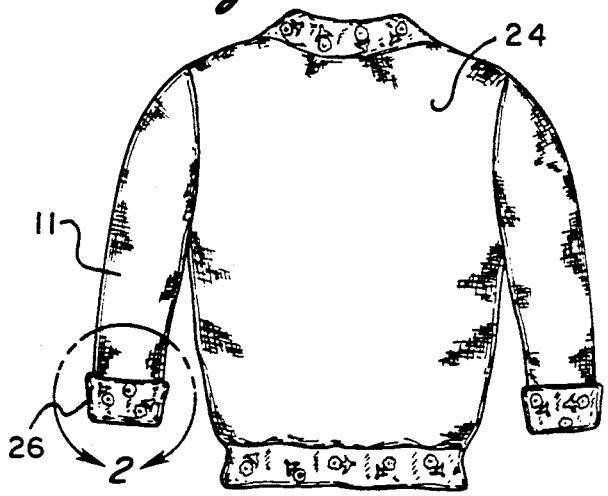
FIG. 1 is a front view of a garment having the puppet therein but hidden from view.
Figure 2:
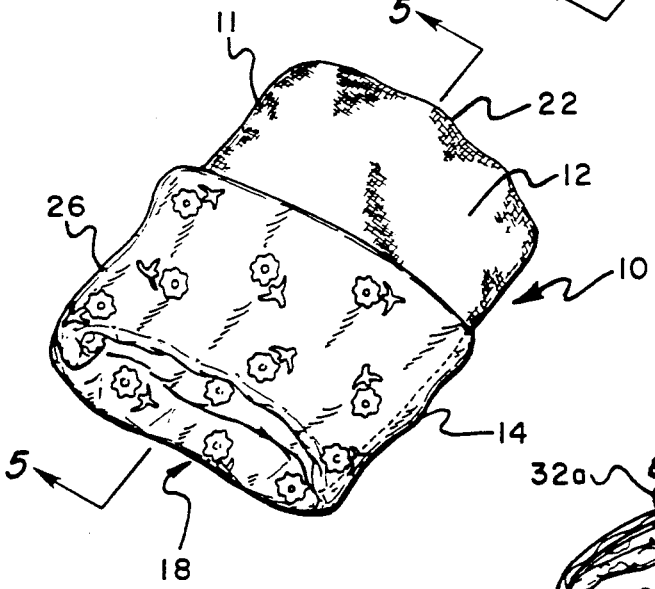
FIG. 2 is an enlarged perspective view of a sleeve cuff taken along line 2 of FIG. 1.
Figure 4:
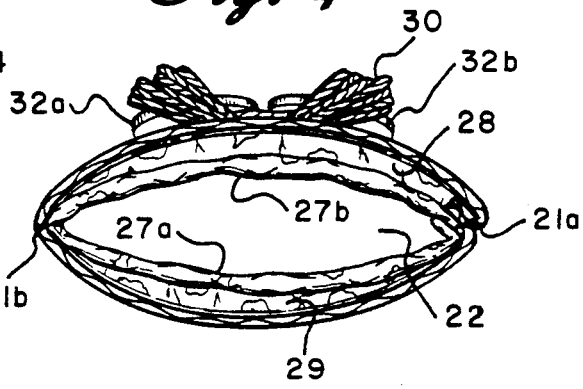
FIG. 4 is a cross-sectional view taken along line 4—4 of FIG. 3.
Figure 7:
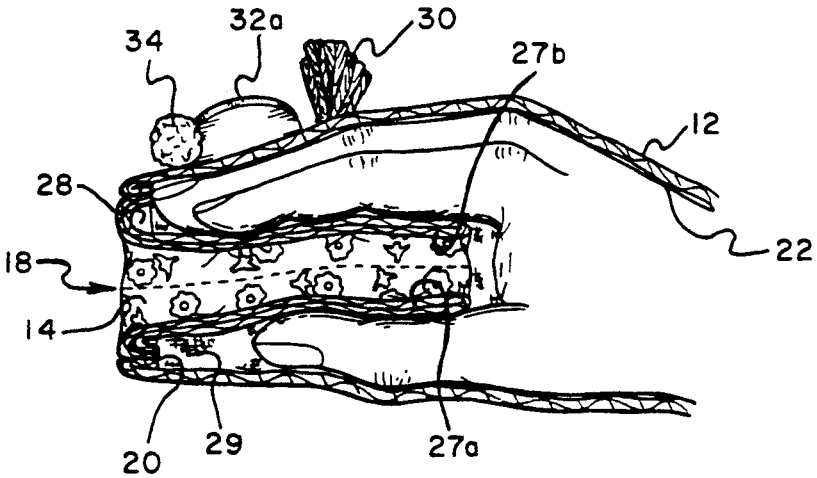
FIG. 7 is a cross-sectional view of the sleeve puppet showing a wearer's hand inserted therein.

As shown in FIGS. 1 and 2, the garment can resemble an ordinary garment having sleeves with cuffs. However, to the surprise of all and to the enjoyment of the garment wearer, the cuff 26 can be unfolded such that the layer 14 of material is substantially entirely disposed within the outer layer 12. As shown in FIG. 6, the inner layer 14 extends within the outer layer 12 in a concentric manner. Because of the concentric arrangement and the unattached interior end 22 as well as the unattached bottom and top edges 27*a* and 27*b*, respectively, upper and lower manipulating cavities 28 and 29, as shown in FIGS. 4 and 7, are formed. Manipulating cavities 28 and 29 allow the wearer of the garment to insert his or her fingers, as shown in FIG. 7, into the cavities so as to manipulate the same in a manner resembling a moving mouth. Accordingly, a puppet is formed with the cuff being in the unfolded position as shown in FIG. 3.

The ornamental items, generally noted as 16, are sewn to the outer layer 12 for resembling facial features of the puppet. More particularly, yarn 30 can be sewn to the outer layer 12 for resembling hair, buttons 32*a* and 32*b* can be sewn to the outer layer 12 for resembling the eyes, and a puff of material 34 can be sewn between the buttons 32*a* and 32*b* for resembling a nose. FIG. 3 denotes only one embodiment of the facial features the puppet may have, it being understood that many different variations of facial features can be arranged on the outer layer of material 12 for forming different amusing faces. Furthermore, while ornamental items are shown as being sewn onto the outer layer 12, it should be readily apparent that such items can be attached utilizing other means such as adhesive or could be simply printed onto the fabric.

Figure 5:
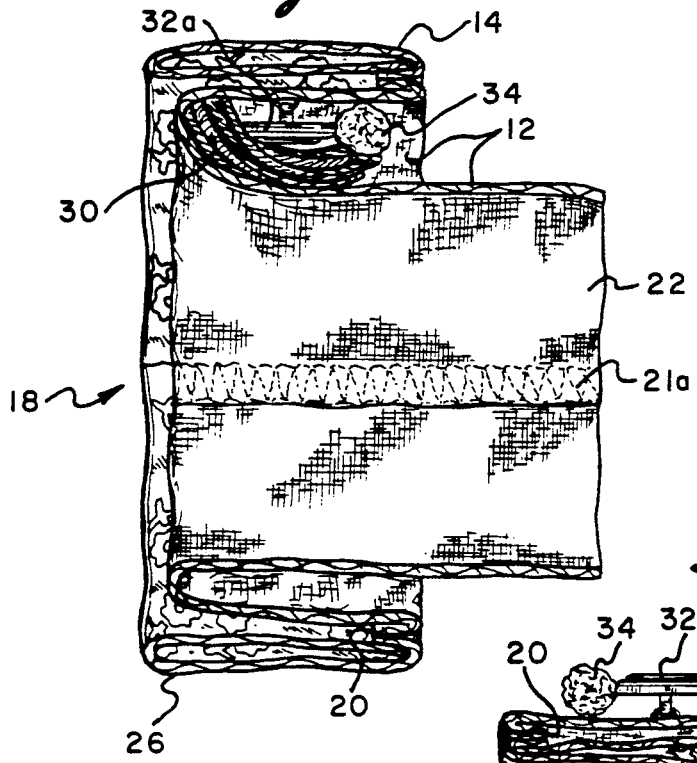
FIG. 5 is a cross-sectional view taken along line 5—5 of FIG. 2.

As shown in FIG. 2, when it is desired that the garment 24 take on an ordinary look, the cuff 26 can be folded as shown in detail in FIG. 5. The outer layer 12 is simply folded inwardly while the inner layer 14 is folded outwardly to form the cuffs as shown in FIG. 1. As such, the ornamental items which create the facial features of the puppet are hidden under the folded layer 12 or the cuff 26 while the ornamental nature of the inner layer 14 is exposed to sight. While FIG. 1 shows only the right-handed sleeve having the puppet therein, it is within the scope of this invention that a puppet can exist on both sleeves. Similarly, the facial features of the puppets on both sleeves can differ so as to create different puppet images in the same garment.

The invention is used in the following manner. The garment 24 is worn by a person desiring to use the puppet and when it is desired that the garment be worn in an ordinary fashion, it is worn with cuffs 26 as shown in FIGS. 1 and 2. However, when the wearer of the garment decides to use a sleeve of the garment as a puppet, the cuff 26 is unfolded revealing the configuration as shown in FIGS. 3 and 6. In the unfolded position, FIG. 3, the sleeve will extend past the hand of the person wearing the garment as shown in FIG. 7. Accordingly, the hand may be inserted in the upper and lower cavities 28 and 29, respectively, so as to manipulate the puppet to imitate a moving mouth. Referring to FIG. 7, the fingers are simply moved up and down for resembling the movements of a mouth. As such, the inner layer 14 acts as the mouth, and the outer layer 12 acts as the face of the puppet.

The present invention may be embodied in other specific forms without departing from the spirit or essential attributes thereof and accordingly reference should be made to the appended claims rather than to the foregoing specification as indicating the scope of the invention.

What is claimed is:

1. A garment having a left sleeve and a right sleeve; each of said sleeves having a main portion comprised of fabric material formed in a substantially cylindrical tubular shape defining an interior and outer surface and having a central axis extending from the distal end thereof through the substantial length of the sleeve; the extreme distal end of each of said sleeves defining a perimeter which lies in a single plane substantially perpendicular to the axis of the sleeve; at least one of said sleeves having an additional tubularly shaped fabric member coaxially located within the interior thereof adjacent the distal end, said tubularly shaped member having a first end secured to the distal end of its respective sleeve around the entire perimeter thereof and having a second end lying within the interior of the sleeve, said additional tubularly shaped member being stitched substantially throughout its length to said main portion of said sleeve along two opposed axially extending lines thereby forming upper and lower cavities between said additional tubularly shaped member and said main portion, the cavities being respectively adapted to receive the wearer's thumb and fingers for manipulating the end of said sleeve in the manner of a hand puppet, decorative means applied to the outer surface of said at least one sleeve adjacent the end thereof so as to resemble facial features of an animal with said tubularly shaped member forming a mouth thereof, said additional tubularly shaped member and the end of the sleeve being capable of being folded back over the outer surface of said sleeve to form a cuff and to hide said decorative means from view.

2. The invention according to claim 1 wherein both of said sleeves are constructed in substantially the same manner.

3. The invention according to claim 1 wherein said decorative means are printed on said sleeve.

* * * * *